US008926398B1

(12) United States Patent
Mendeleev et al.

(10) Patent No.: US 8,926,398 B1
(45) Date of Patent: Jan. 6, 2015

(54) UNDER GARMENT

(71) Applicants: Ruzaliya Mendeleev, Brooklyn, NY (US); Boris Mendeleev, Brooklyn, NY (US)

(72) Inventors: Ruzaliya Mendeleev, Brooklyn, NY (US); Boris Mendeleev, Brooklyn, NY (US)

( * ) Notice: Subject to any disclaimer, the term of this patent is extended or adjusted under 35 U.S.C. 154(b) by 0 days.

(21) Appl. No.: 14/090,970

(22) Filed: Nov. 26, 2013

Related U.S. Application Data

(60) Provisional application No. 61/729,961, filed on Nov. 26, 2012.

(51) Int. Cl.
*A41C 3/00* (2006.01)
*A41C 3/08* (2006.01)

(52) U.S. Cl.
CPC ..... *A41C 3/08* (2013.01)
USPC ..... 450/61; 450/31; 450/8

(58) Field of Classification Search
USPC ..... 450/30–33, 36, 55, 56, 60, 61, 65–67, 450/78, 8; 2/67, 104, 105, 106, 113–115
See application file for complete search history.

(56) References Cited

U.S. PATENT DOCUMENTS

| | | | | |
|---|---|---|---|---|
| 2,505,720 | A | 4/1950 | Peiser et al. | |
| 5,603,653 | A | 2/1997 | Hartman | |
| 5,839,942 | A | 11/1998 | Miller | |
| 5,858,014 | A | 1/1999 | Kepes et al. | |
| 5,980,359 | A | 11/1999 | Brown | |
| 6,089,954 | A | 7/2000 | Grewe | |
| 6,095,894 | A | 8/2000 | Stevens | |
| 6,203,399 | B1 | 3/2001 | Hackney | |
| 6,264,530 | B1 | 7/2001 | Cosentino | |
| 6,280,287 | B1 | 8/2001 | Keith et al. | |
| 6,341,377 | B1 | 1/2002 | Faries, Jr. et al. | |
| 6,406,353 | B1 | 6/2002 | Harper | |
| 6,439,958 | B1 | 8/2002 | Lorenzo | |
| 7,491,113 | B2 * | 2/2009 | Bowler | 450/60 |
| 7,549,908 | B2 * | 6/2009 | Yudkoff | 450/62 |
| 7,793,358 | B2 | 9/2010 | Frye | |
| 7,794,304 | B2 | 9/2010 | Frye | |
| 7,806,748 | B2 * | 10/2010 | Richardson | 450/61 |
| 8,152,592 | B1 | 4/2012 | Lavigne | |
| 8,267,740 | B1 * | 9/2012 | Afxentiou | 450/86 |
| 8,585,458 | B2 * | 11/2013 | Armanino | 450/31 |
| 2004/0192164 | A1 | 9/2004 | Ajili | |
| 2006/0057937 | A1 * | 3/2006 | Bowler | 450/61 |
| 2008/0004588 | A1 | 1/2008 | Gavitt | |
| 2008/0312616 | A1 | 12/2008 | Nixon | |
| 2013/0045661 | A1 * | 2/2013 | Armanino | 450/31 |

* cited by examiner

*Primary Examiner* — Gloria Hale
(74) *Attorney, Agent, or Firm* — Lawrence G. Fridman

(57) ABSTRACT

The under garment consists of a front panel having an outer side and an inner side. Two shoulder areas are formed at top portions of the front panel and the back panel. A breast receiving unit is provided associated with the inner area of the front panel and is formed with first and second breast receiving pockets. A front area of each receiving pocket is formed by a respective part of the inner face of the front panel and a rear area of each said breast receiving pocket is formed by an independent rear panel. In use, the independent rear panels of each breast receiving pocket are positioned between the skin of the breast and the skin of the user's torso.

14 Claims, 6 Drawing Sheets

UNDER GARMENT

REFERENCE TO RELATED APPLICATION

This Application claims priority of U.S. Provisional Application Ser. No. 61/729,961 filed by the inventors on Nov. 26, 2012, the entire disclosure of which is hereby incorporated by reference.

FIELD OF THE INVENTION

The invention relates to under garments, and particularly to an under garment worn by a woman to manage perspiration and moisture in breast areas.

BACKGROUND OF THE INVENTION

Women's breasts naturally perspire throughout the day and night, even during times of relatively light activity. In the female body, moisture perspiration tends to accumulate in an area directly beneath the breasts and between the breasts. This creates a generally wet and uncomfortable environment against the skin, which can promote bacteria and fungus growth. These conditions are especially severe for elderly, disabled and sick female persons, or patients in hospitals and nursing facilities, who often spend substantial time lying in bed. In such conditions, breasts are drawn by gravitational forces against the skin of the torso further exacerbating the discomfort.

Traditional brassieres worn by such individuals create further discomfort. Recently, some authorities have stated that traditional bra use, particularly those employing underwires, heavy elastic, cups, pads, bands and seams, press directly on a woman's lymphatic system in the breasts and surrounding area thereby preventing the lymphatic system from flushing the body of toxins that can accumulate in breast tissue and lead to breast cancer.

In traditional brassieres, cups engaging the breasts and bands of the shoulder areas compress, chafe, and irritate the skin of the wearer in general and front rib cage and back in particular. The under-band beneath the breasts can cause substantial friction with the human skin which results in excess perspiration. As mentioned above, the excess perspiration in combination with the friction can cause rashes and possible infections.

Furthermore, in the prior art, the shoulder areas used in the brassieres continuously slide down the shoulders and upper arms of the user, even if the shoulder areas are adjustable. Such prior art shoulder areas cut and dig into and painfully compress the shoulder area, creating deep grooves. It is quite often that traditional shoulder areas cause extreme pain especially in elderly, disabled and sick female persons often requiring certain types of surgeries, such as rotary cuff surgeries and surgeries to alleviate bursitis.

The many the prior art brassieres and under garments do not prevent undesirable skin-on-skin contact and do not efficiently transport moisture from the crease formed between the under breast area and the chest surface to a fabric of the under garment.

Still further, many prior art brassieres use fabrics that are either one hundred percent synthetic or partially synthetic. Unfortunately, many women are allergic to synthetic materials and break out in painful, itchy rashes. Furthermore, after surgery, some women become more sensitive to synthetic materials. Therefore, brassieres that employ synthetic materials can cause further discomfort.

SUMMARY OF THE INVENTION

One object of the invention is to provide the under garment with limited breast support which is comfortable for use day or night and especially by the elderly, disabled and sick female persons, or patients in hospitals and nursing facilities who often spend substantial tune lying in bed. No cups are provided and only breast receiving pockets are employed to provide minimal stability to the breasts.

Another object of the invention to provide an under garment of low cost, without hardware, heavy elastic, or side seams and with shoulder areas designed to avoid slipping off the shoulders of a wearer. It is made of a breathable, perspiration absorbing fabric which eliminates irritation.

The garment of the present invention effectively handles perspiration and creates a drier environment for the breasts and effectively moves moisture away-from the skin as the body naturally perspires.

The under garment of the invention can be worn to help transport moisture from the breast skin to an area of the garment where it can be more easily evaporated. The undergarment prevents undesirable skin-on-skin contact and transports moisture from the crease formed between the under breast area and the chest surface to a fabric of the inner protective area of the garment. This creates a drier, more comfortable, and more healthful environment for the breasts. In actuality, the design of the garment of the invention effectively handles this moisture by quickly moving it from the skin, and ultimately to the atmosphere.

The invention relates to an improved under garment and is specially adapted for use in hospitals, geriatric facilities or any woman confined to bed. The object of the invention is to provide an undergarment which may be placed upon the patient or removed therefrom, with minimal body manipulation.

DETAILED DESCRIPTION OF THE INVENTION

Figure 1:
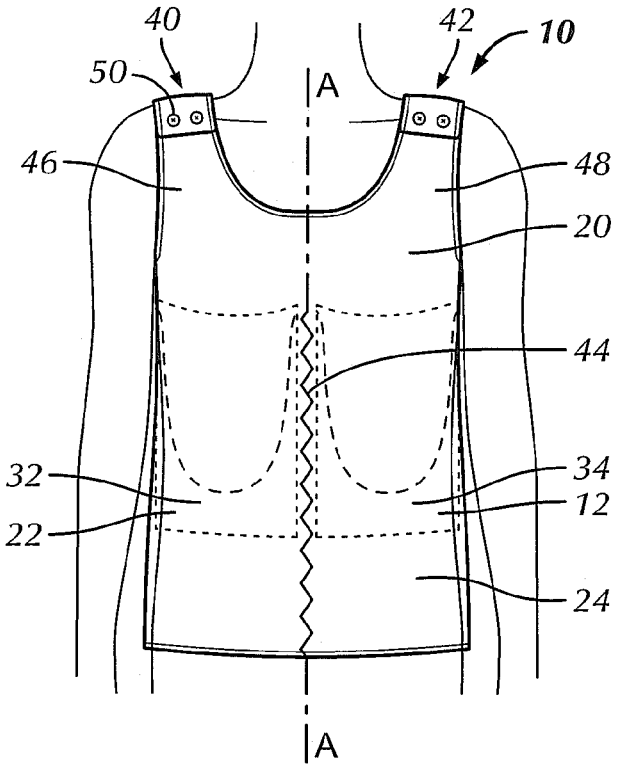
FIG. 1 is a front elevational view showing one embodiment of the under garment of the invention.
Figure 2:
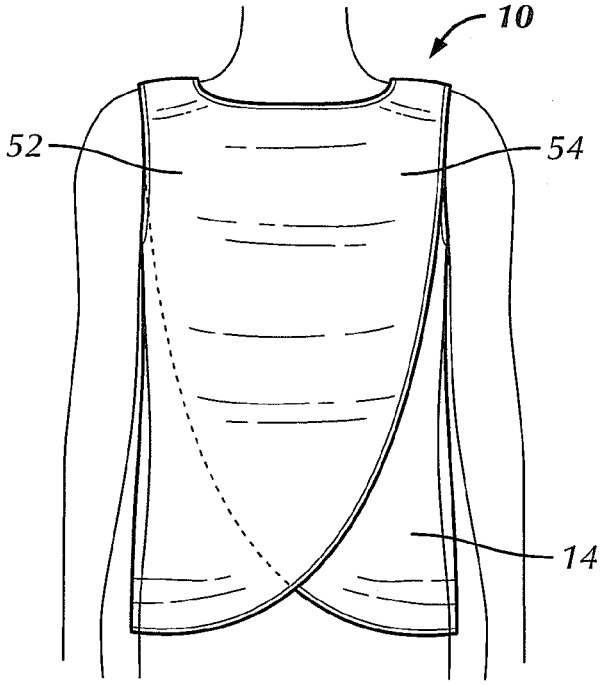
FIG. 2 is a rear elevational view thereof.

It will be discussed below, that the invention is directed to a breast perspiration/moisture managing under garment, which effectively handles the perspiration and moisture in the breast areas. This creates drier, more comfortable environment for a wearer.

Referring to the drawings, wherein like reference numerals represent like parts throughout the various drawing figures, reference numeral 10 is directed to the under garment which can be worn by a woman to prevent skin-to-skin contact and to transport moisture from the breasts to the fabric of garment.

Figure 9:
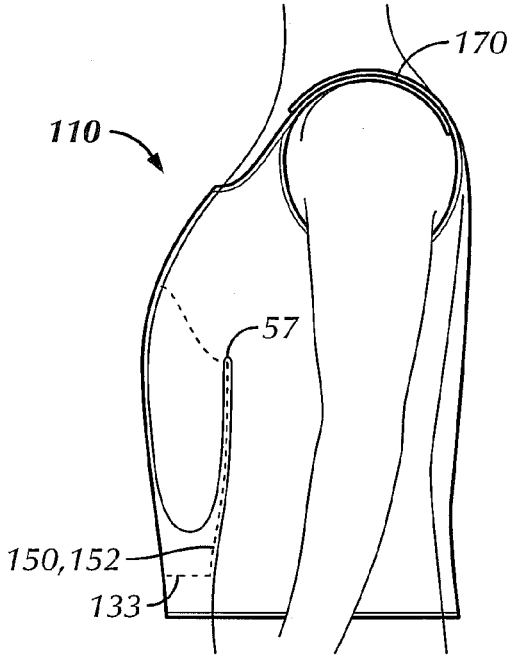
FIG. 9 is a side view of the embodiment of FIG. 8 showing the breast receiving pocket.
Figure 10:
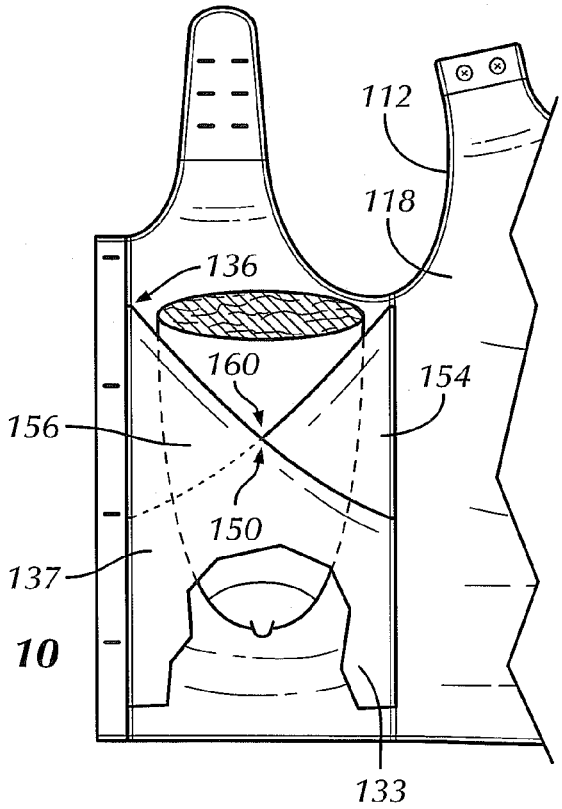
FIG. 10 is a view of the breast receiving pocket, with partial cut-out showing a breast positioned inside.
Figure 11:
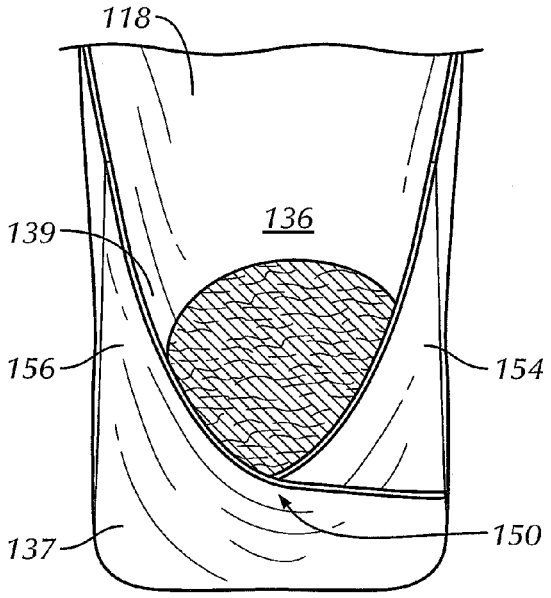
FIG. 11 is an inside out view of the embodiment of FIG. 8 showing the breast receiving pocket.
Figure 12A:
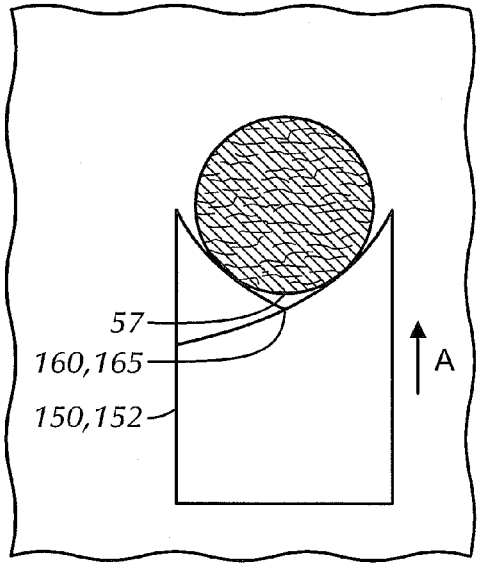
FIG. 12A is a diagram illustrating one position of the an inner protective arrangement relative to a breast of the wearer.

The under garment 10 is configured to have an inner protective area to be positioned under a person's breasts, so as to separate the breasts from the person's chest/torso. This area of the person's body will be referred to herein as "the breast fold line," namely this is a region where a crease is formed in between the breast under breast area and the chest surface. The breast fold line 57 is shown in at least FIGS. 3, 9 and 12.

The under garment 10 of the invention consists of front 12 and rear 14 regions connected to each other. The front region is defined by a front panel 16 having inner 18 and outer 20 faces and associated with left 22 and right 24 sides of the garment. A breast receiving unit 30 is associated with the inner area of the front panel 16 which is coupled to the front region of the under garment. Left 40 and right 42 shoulder areas extend from the front and rear regions. A body of the garment is generally symmetrical about a central line A-A. The cleavage area 44 divides the regions of the garment into the left 22 and right 24 sides and can be formed with outer marginal parts which overlap one another. The under garment 10 encircles the body of the wearer, so as to conform to body size and shape to be received around a human torso. The overlapping upper ends 46, 48 of the front region and the upper ends 52, 54 of the back region define portions that are releaseably joined by an adjustment arrangement or shoulder fasteners 50. The front flaps and back flap when joined define large arm holes 60, 62 for receiving arms of the wearer.

For increased comfort and support, the underarm area is cut away to provide arm holes 60, 62 as large as possible for comfort and freedom of movement, but still leaves enough fabric at the side of the garment to provide lateral grip to further prevent skin-to-skin contact.

Figure 6:
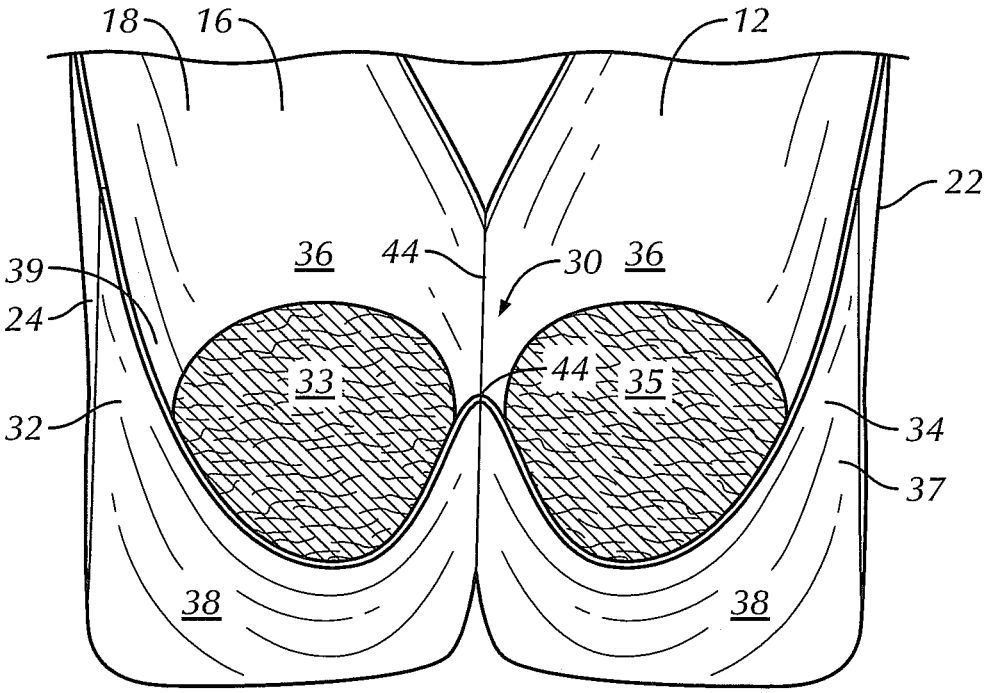
FIG. 6 is an inside out view of the front portion of the garment showing breast receiving pockets.
Figure 7:
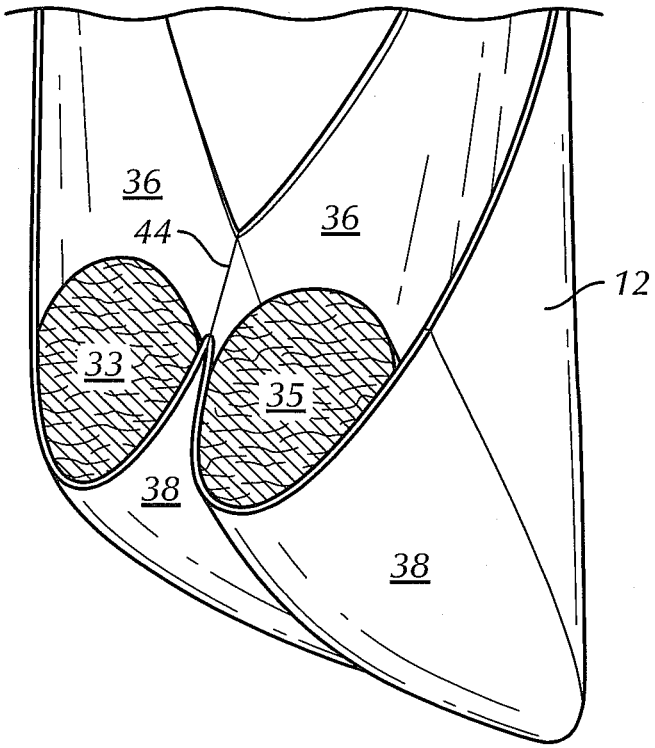
FIG. 7 is an inside out side view of the front portion of the garment similar to that of FIG. 6.

Turning now, to the breast receiving unit 30 which is formed with first 32 and second 34 breast receiving pockets. In the illustrated embodiment of the invention, a front area 36 of each receiving pocket is formed by a respective part of the inner face 18 of the front region or panel 12, and a rear area 37 of each breast receiving pocket is formed by its own rear panel 38. A hollow inner space 39 is defined between front 36 and rear 37 areas of each pocket. In FIGS. 6 and 7 portions of breasts 33, 35 are shown positioned within the receiving pockets for illustration purposes. The first 32 and second 34 breast receiving pockets are independent from each other and separated by the intermediate cleavage area 44. In one of the embodiments embodiment, the cleavage area 44 can defined by stitching, so that the rear panels 38 of the first and second breast receiving pockets are stitched or attached in any other conventional manner to the front panel 12 of the garment. It will be discussed below, that a portion of each breast receiving pocket is positioned between the breast and the torso of a female wearer to prevent undesirable skin-to-skin contact.

Figure 3:
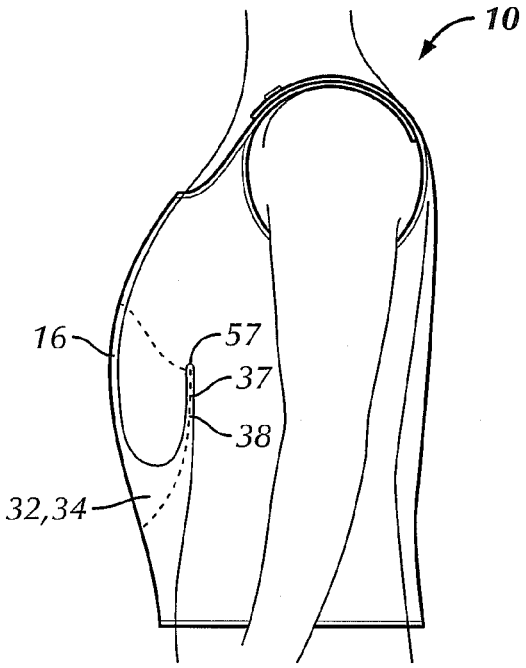
FIG. 3 is a side view showing the breast receiving pocket.
Figure 4:
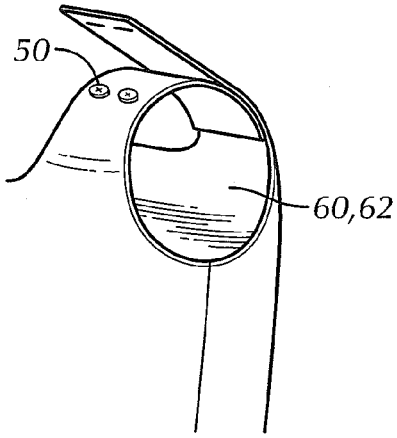
FIG. 4 is a view showing an adjusting arrangement in a disengaged condition.
Figure 5:
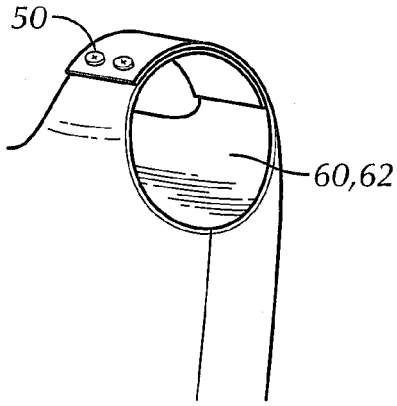
FIG. 5 is a view showing the adjusting arrangement in an engaged condition.

As best illustrated in at least FIG. 3, in use the rear panels 38 of the breast receiving pockets 32, 34 extend to the breast fold line 57, and within the region where a crease is formed in between the breast under breast area and the chest surface. Such position of the rear panels 38 prevents undesirable skin-on-skin contact. The breast receiving pockets 32, 34 in general and the rear panels 38 thereof in particular, transport moisture from the breast skin to the fabric of the arrangement, where the moisture evaporates more efficiently. Thus, the design of the under garment of the invention effectively handles the human moisture by quickly moving it from the breast skin of the wearer to the fabric of the garment and ultimately to the atmosphere.

The adjustment of the garment and fitting of the garment with respect to the body of the wearer is facilitated by the adjustment arrangement 50 provided at the shoulder areas. The adjustment arrangement 50 can be in the form of any conventional arrangements including but not limited to buttons, Velcro, loop or hook arrangement etc. By releasing the adjustment arrangement 50 and pulling the under garment upwardly, so that it can be adapted to a more tighter or more loose fit with the body of the wearer. For example, by raising the level of the upper area of the garment, facilitated by the adjustment arrangement 50, the garment including the rear panels 38 can be pulled upwardly in the direction of the breast fold line 57. In this manner the rear panel 38 is interposed between the breast under breast area and the chest surface, so as to minimize contact between the respective skin areas.

One of the essential features of the illustrated embodiments is that the inner space 39 of the breast receiving pockets is greater than the size of the breast positioned thereinside (see FIGS. 3 and 6, for example). This allows the breasts to be in a loose position within the respective pockets 32, 34. There is no need for the fabric to closely follow the contour of the breast. In this manner, the breast pockets design of the present invention is configured to automatically conform to the changing size and shape of the breast moment by moment throughout the day and night during and following the healing process.

Referring now to FIGS. 8-12 illustrating another embodiment 110 of the under garment of the invention, which is in some respects is similar to the above-discussed embodiment. The breast receiving unit is formed with first 132 and second 134 breast receiving pockets. It should be noted that, in this embodiment of the invention there is no support provided for the breasts from the bottom region of the garment and from the lower part of the breast receiving pockets. The breast receiving pockets 132 and 134 are open at an outer ends thereof 133. Similar to the above-discussed, an essential aspect of this embodiment is to prevent undesirable skin-on-skin contact and to transport moisture from the crease formed between the under breast area and the chest surface to a fabric of the inner protective area of the garment.

In the illustrated embodiment of the invention, a front area 136 of each receiving pocket is formed by a respective part of the inner face 118 of the front region or panel 112, and a rear area 137 of each breast receiving pocket is formed by its own rear panel 138. A hollow inner space 139 is defined between front 136 and rear 137 areas of each pocket. The rear area of each pocket is defined by an inner protective arrangement 150, 152 extending between the respective outer edges and in use is disposed between the skin of the breast and the skin of the torso of the wearer.

Each inner protective arrangement 150, 152 consists of inner 154 and outer 156 segments or layers of a fabric interposed on each other. When the under garment 110 is worn by a wearer, the inner segment 154 faces an inner skin of the breast and the outer segment 156 faces the skin of the torso. Top portions 158, 162 of the segments are formed having an angle-shaped configuration, diagonally extending between the first and second outer edges. In this manner angle-shaped engaging recesses 160, 165 are formed by the interposed inner and outer segments at the top region of the inner protective area of each breast receiving pocket.

Although the angle-shaped engaging recess is being discussed in this embodiment, it should be obvious that different configurations of the engaging recesses are within the scope of the invention. For example, the recess can be formed having curved or trapezoidal configuration.

The inner and outer segments 154,156 are typically formed from a single piece of fabric, which is folded at the bottom, so as to provide a double layer formation. It should be noted however, that each segment can be formed from an independent piece of fabric.

Figure 12B:
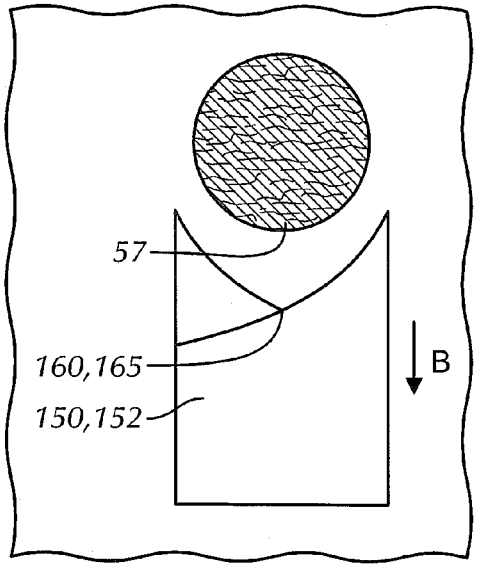
FIG. 12B is a diagram illustrating another position of the inner protective arrangement relative to the breast of the wearer.

The adjustment arrangement 170 is provided at the shoulder areas of the garment, so as to adjust the breast receiving pockets including the rear protective areas relative to the user's body in general. More specifically, the adjustment arrangement 170 enables the invention to manipulate positioning of the inner protective arrangements 150, 152 at the breast fold line 57 in general and specifically within the region where a crease is formed in between the breast under breast area and the chest surface. By manipulating the adjustment arrangement 170, the inner protective arrangements 150, 152 and the respective engaging recesses can be adjusted either upwardly or downwardly on the body of the wearer within the space between the breast and the torso. Thus, the engaging recesses 160, 165 can be adapted to be positioned closer to or engage the breast fold line 57 (see FIG. 12A). On the other hand, it can be adjusted, so as to lower the engaging recess 160,165 to a position where the recess is positioned remotely from the breast fold line 57. This more loose fit of the under garment is schematically illustrated in FIG. 12B. Thus, in the invention by manipulating the adjustment arrangement 170 provided at the upper shoulder areas of the garment, the inner protective arrangements 150, 152 in general and the engaging recess 160, 165 specifically can be pulled upwardly to occupy the space between the breast and the torso and for the recess to engage the breast fold line. In this position, contacts between the skin of the torso and the skin of the breast are minimized. The angle-shaped engaging recesses 160, 165 are adapted for a better engagement of the inner protective arrangement with the area of the wearer's body in the vicinity of the breast fold line 57. On the other hand, upon lowering the level of the engaging recess by means of the adjusting arrangement, it is moved away from the breast fold line 57 providing more loose fit between the garment and the human body.

The shape of the engaging recesses 160, 165 depends on the size of the undergarment and corresponding breast size. The recesses are sized and shaped to fit under the breasts along breast fold lines 57 at breast-chest/torso junctures (where breast-to-chest and skin-to-skin contacts typically occur if it is not prevented by the undergarment of the invention). More specifically, in use the engaging recess 160, 165 are disposed in close proximity to the fold lines 57 extending along substantially entire lengths thereof. The length of a top area of the recess is preferably long enough such that the recess area extends at least under a substantial portion of the breast-chest fold lines 57. The top area of the recess typically does not extend outwardly significantly beyond the fold line 57 or beyond the breasts.

The engaging recess conforms to the curvature underside of the breasts, below the fold line 57, and typically dos not to come up from underneath the breasts. In use, especially when the user is in a horizontal position, the weight of the breasts against the inner protective area helps to hold the under garment 110 in place. This is especially noticeable for bed ridden patients, who spend substantial time laying on their back in a horizontal position. The position of the inner protective arrangement is such that it provides sufficient friction against the garment under weight of the breasts to hold the under garment 110 substantially stationary while in use. Position of the protective arrangement 150, 152 is such that the arrangement prevents movement of the garment 10 while in use, yet not extend substantially beyond undersides of the breasts.

The material layers are flexible and make the garment 110 absorbent and moisture-retaining, and such that the garment may be disposable or more durable/washable/reusable. In an alternate embodiment of the invention, the garment 110 may be reversible and symmetric such that either layer may be placed against the user's chest. Thicker garments can be provided for use in hot and/or humid conditions. The under garment 110 is configured to wick away moisture from, and to provide an air pathway, underneath, in between, and around the breasts. The under garment 110 comprises air-laid, non-woven, hygienic, hypo-allergenic, material such as cotton, silk or other moisture-retaining material and/or a stabilizing, breathable material. Materials of the layers may vary depending on desired comfort and absorbency.

The absence of the bottom portion of the breast receiving pockets further emphasizes an important aspect of the present embodiment to provide a medical garment adapted for use by bed-ridden patients spending substantial time lying in bed on their back and not a conventional brassiere.

In use of the garment of the invention, because of the open end area 133 of the breast receiving pockets, the breasts can be touched and manipulated by hand from the bottom of the breast receiving pockets, so as to provide another adjustment accommodating the inner protective arrangement within the space between the breast and the torso. In this process, the engaging recess is also adjusted and placed either closer to or further away from the breast fold line 57.

In the present embodiment, the longitudinal adjustment of the inner protective arrangement with respect to the body of a patient is provided by moving the engaging recess in the direction toward or away from the breast fold line. The major function of the adjustment arrangement is to adjust position of the inner protective arrangement and not the entire breast receiving pockets, as typically occurs in the prior art garments. The adjustment arrangement is adapted to adjust longitudinally position of the inner protective arrangements, by moving the triangular-shaped upper region toward or away with respect to the breast fold line.

The essential distinction of the invention over the prior art undergarments is that in the invention, the adjustment arrangement is provided to adjust and manipulate only the protective arrangement within the space between the breast and the torso. In view of the open end design of the breast receiving pockets during the above-discussed manipulation, the breasts themselves are practically not affected and remain substantially stationary. On the other hand, in the conventional brassieres and similar under garments, by adjusting shoulder straps, position of not only the receiving pocket but also the breasts positioned within such pockets, are moved and manipulated.

Figure 8:
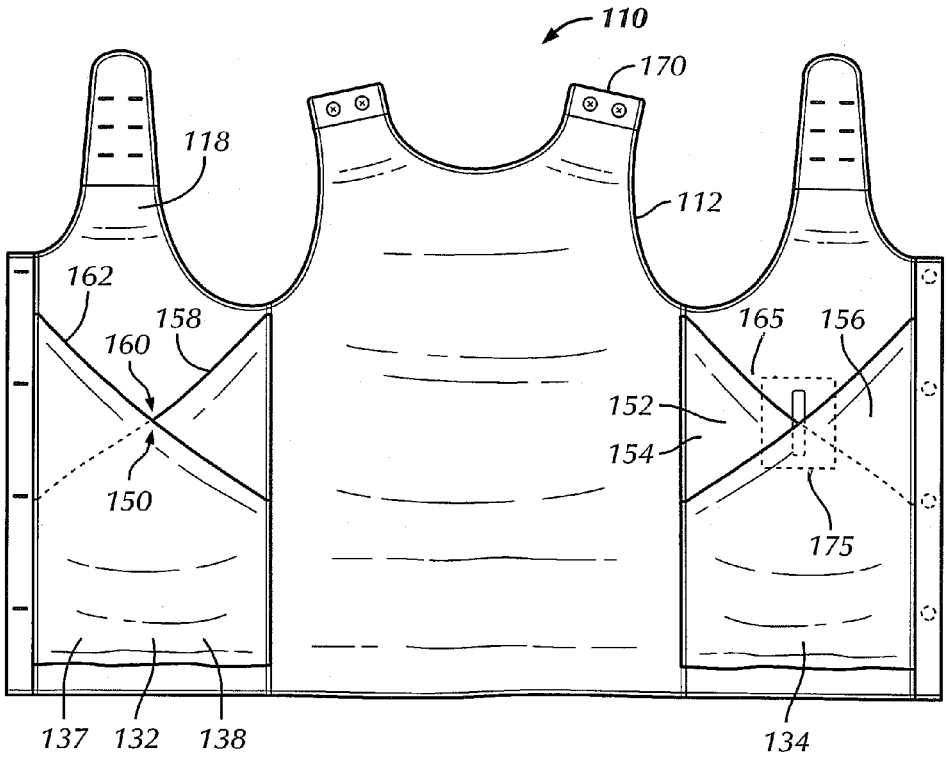
FIG. 8 is a view showing a flat initial condition of another embodiment the under garment of the invention, prior to being worn by a wearer.

As illustrated in FIG. 8, a slot can be provided within an outer pocket 175 of the garment to facilitate insertion and/or removal of wires and other medical devices required for treatment of a patient.

The above discussed design of the breast receiving pockets facilitates each breast to find its own level for comfort and to conform to its own shape and size. This is essential after breast surgery. The soft comfortable fabric soothes and mitigates pain while protecting tender tissues and medicated areas. The under garment practically eliminates skin-on-skin problems in the breast areas, which is extremely important in many medical conditions, including thoracic surgery, burn treatment, etc.

One of the main functions of the garment is to eliminate skin-on-skin contact of a patient in general, and to eliminate contact between the skin of the breast and the skin of the torso of the wearer in particular. The loose fit of the breast receiving pockets is mainly provided for the purpose of separation and not for the purpose of support. The breasts are inserted into the pockets and loosely positioned inside. This makes the garment very comfortable to wear. Furthermore, the loose arrangement between the pockets and the breasts makes a concept of once size fits all applicable to the present invention. There will requirement for a limited variety of the garments to be manufactured to meet the demand of the consumers. The breast receiving pockets mainly separate the skin of the breast from the skin of the torso of the person wearing the garment.

The present invention provides under garment that can be easily custom sized and comfortable for many sizes of ribcage and breast sizes. The under garment is machine washable and dryable, is reasonably priced, and is formed of material that breaths to reduce pain and is lightweight to reduce the costs of storage and handling. Thus, the under garment of the present invention can be used by and will be beneficial to those having post-surgery needs, arthritis, shingles, requiring comfort day and night, and especially those spending substantial time in bed.

The under garment of the invention is devoid of typical brassieres hardware such as clips, hooks, buckles, constructional wiring, elastic bands, or plastic supports which can dig into the skin of a wearer and be a source of discomfort. Further, it is devoid of rough seams, darts or ventilation openings especially in the breast supporting area of front panel, so nipple or breast irritation is avoided.

Since the breast receiving pockets of the invention are specifically designed to provide loose fit between the breasts and the fabric, the under garment does not inhibit lymphatic circulation and does not cause redness or other discomfort.

While the above description contains many specificities these should not be construed as limitations on the scope of the invention, but rather as an exemplification of one preferred embodiment thereof. Many variations are possible. For example, instead of fabric consisting of 100% cotton interlock, the fabric could be in different composition, styles, solid or designs. The garment of the invention can be made with a combination of cotton and other natural fibers, a different weight of cotton, either one-way stretch or two-way stretch.

From the foregoing, it will be appreciated that although specific embodiments of the invention have been described herein for purposes of illustration, various modifications may be made without deviating from the spirit and scope of the invention.

The invention claimed is:

1. An under garment preventing a contact between a skin of a breast and a skin of a wearer's torso, comprising:

a front panel having an outer side and an inner side; a back panel having left and right edges attached to corresponding edges of the front panel; two shoulder areas formed at top portions of the front panel and the back panel; a breast receiving unit associated with the inner area of the front panel and is formed with first and second breast receiving pockets, each said pocket extending between top and bottom portions thereof, each said pocket is open at the respective bottom portion; a front area of each said breast receiving pocket is formed by a respective part of the inner side of the front panel and a rear area of each said breast receiving pocket is formed by an independent rear panel, wherein in use said independent rear panels of each said breast receiving pocket are positioned between the skin of the breast and the skin of the wearer's torso, so as to prevent undesirable skin-on-skin contact and transport moisture from the breast skin to a fabric of the under garment.

2. An under garment of claim 1, wherein an inner space of each said breast receiving pockets is greater than the size of the breast positioned inside, to allow the breasts to be in a loose position within the respective pockets, so that the breast pockets are configured to a conform to the changing size and shape of the breast.

3. An under garment of claim 1, wherein the first and second breast receiving pockets are independent from each other and separated by an intermediate region, said intermediate region is defined by a connecting area where the rear panels of the breast receiving pockets are attached to the front panel.

4. An under garment of claim 1, wherein each shoulder area is formed with an adjustment arrangement for adjustment and fitting of the under garment with respect to a body of the wearer.

5. An under garment of claim 1, wherein overlapping ends of the front region and the back region define portions that are releaseably joined by the adjusting arrangement by releasing the adjustment arrangement and pulling the under garment upwardly an under arm area is adjusted, so as to provide tighter or more loose fit with the body of the wearer.

6. An under garment comprising:

a front panel having an outer side and inner side; a back panel connected to the front panel; two shoulder areas formed at the top portion of the front panel and the back panel; a breast receiving unit associated with the inner area of the front panel is formed with first and second breast receiving pockets; a front panel having an outer side and inner side; a back panel connected to the front panel; each said pocket extending between top and bottom portions thereof, each said pocket is open at the respective bottom portion; a front area of each said receiving pocket is formed by a respective part of the inner face of the front panel and a rear area of each said breast receiving pocket is formed with an inner protective arrangement;

said inner protective arrangement is formed by inner and outer segments interposed on each other, top portions of said segments are arranged, so as to form an engaging recess, and an adjustment arrangement provided at shoulder areas of the garment, so as to adjust the breast receiving pockets and the inner protective arrangements relative to a body of the wearer.

7. An under garment of claim 6, wherein said engaging recess is formed by the interposed top portions of the inner and outer segments at the top portion of the inner protective arrangement provided at the rear area of each said breast receiving pocket.

8. An under garment of claim 7, wherein said adjustment arrangement enables to manipulate positioning of the inner protective arrangement at a breast fold line and within a region between a skin breast and a skin of wearer's torso.

9. An under garment of claim 8, wherein a position of the inner protective arrangements and the engaging recesses are adjusted upwardly and downwardly within the space between a skin breast and a skin of wearer's torso.

10. An under garment of claim 9, wherein upon upward motion of each said breast receiving pocket, the respective engaging recess is adapted for engagement with the breast fold, line.

11. An under garment of claim 9, wherein upon downward motion of each said breast receiving pocket on the body of the wearer, the engaging recess is positioned remotely from the breast fold line.

12. An under garment of claim 6, wherein the breast disposed within the breast receiving pocket can be manipulated by a hand from the open bottom end of the receiving pocket.

13. An under garment of claim 8, wherein said engagement arrangement transports moisture from the skin of the breast and the skin of the torso to a fabric of the under garment.

14. An under garment of claim 8, wherein the rear panels of the breast receiving pockets are positioned between the breast skin and the skin of the wearer's torso for transporting moisture from the breast skin to a fabric of the under garment.

* * * * *